US005189476A

United States Patent [19]

Anno et al.

[11] Patent Number: 5,189,476

[45] Date of Patent: Feb. 23, 1993

[54] DEVELOPING DEVICE FOR PRODUCING A DEVELOPED IMAGE

[75] Inventors: Masahiro Anno; Hiroshi Mizuno; Kouichi Etou; Eiichi Sano, all of Osaka, Japan

[73] Assignee: Minolta Camera Kabushiki Kaisha, Osaka, Japan

[21] Appl. No.: 519,645

[22] Filed: May 7, 1990

[30] Foreign Application Priority Data

May 9, 1989 [JP] Japan ..... 1-116490

[51] Int. Cl.[5] ..... G03G 15/08

[52] U.S. Cl. ..... 355/259; 118/658; 355/251

[58] Field of Search ..... 118/653, 656, 657, 658, 118/651; 355/250, 245, 259, 251, 253; 428/36.4, 375, 397

[56] References Cited

U.S. PATENT DOCUMENTS

| | | | |
|---|---|---|---|
| 4,057,666 | 11/1977 | Drummond, Jr. | 428/36.4 X |
| 4,260,445 | 4/1981 | Mayumi et al. | 428/36.4 X |
| 4,377,332 | 3/1983 | Tamura | 355/253 |
| 4,408,862 | 10/1983 | Takano et al. | 355/250 |
| 4,445,771 | 5/1984 | Sakamoto et al. | 355/253 |
| 4,469,138 | 9/1984 | Satoh | 428/36.4 X |
| 4,564,285 | 1/1986 | Yasuda et al. | 355/253 |
| 4,575,218 | 3/1986 | Sakamoto et al. | 355/253 |
| 4,576,463 | 3/1986 | Sakamoto et al. | 355/253 |
| 4,791,882 | 12/1988 | Enoguchi et al. | 355/259 X |
| 4,836,136 | 6/1989 | Natsuhara | 118/657 |
| 4,915,902 | 4/1990 | Brupbacher et al. | 420/129 |
| 4,994,319 | 2/1991 | Nojima et al. | 428/335 |
| 4,997,703 | 3/1991 | Gehrig | 428/397 |
| 5,045,891 | 9/1991 | Senba et al. | 355/289 |

FOREIGN PATENT DOCUMENTS

| | | | |
|---|---|---|---|
| 63-241579 | 10/1963 | Japan . | |
| 0161565 | 12/1981 | Japan | 118/657 |
| 0108891 | 7/1982 | Japan | 355/250 |
| 0109966 | 7/1982 | Japan | 355/250 |
| 0007668 | 1/1983 | Japan | 355/250 |
| 58-211172 | 12/1983 | Japan . | |
| 2088252 | 6/1982 | United Kingdom | 118/658 |

*Primary Examiner*—A. T. Grimley
*Assistant Examiner*—T. Dang
*Attorney, Agent, or Firm*—Burns, Doane, Swecker & Mathis

[57] ABSTRACT

The present invention discloses a monocomponent developing device including a developing sleeve for developing an electrostatic latent image formed on the surface of a photoreceptor by supplying a toner to the electrostatic latent image. The developing sleeve contains a whisker with 0.1 μm to 1 μm outside diameter at least in a surface layer thereof.

13 Claims, 5 Drawing Sheets

DEVELOPING DEVICE FOR PRODUCING A DEVELOPED IMAGE

BACKGROUND OF THE INVENTION

1. Field of the Invention

The present invention relates to a developing device for use in electrophotographic copy machines, and more specifically relates to a developing device that produces a developed image by having a thin layer of a monocomponent developing material comprising only a toner make contact with an electrostatic latent image formed on the surface of a photoconductive member.

2. Description of the Prior Art

Conventional monocomponent developing devices provide concavo-convexities on the surface of a developing sleeve to improve toner transportability and transportable quantity to the surface of said developing sleeve as well as to sufficiently impart a charge to said toner.

A monocomponent developing device having a developing sleeve provided a roughened surface thereon, said roughened surface being accomplished by sandpaper or the like on the surface of said developing sleeve is disclosed in U.S. patent application No. 4,377,332. However, when the surface of a developing sleeve is roughened by providing sandpaper or the like on the surface thereof, the concavo-convexities are sharp and cause damage to the photoconductive member through friction, thereby reducing the durability of the device.

On the other hand, Japanese Patent Application No. 63-241579 discloses a developing device providing a fiber-like filler material of glass fiber or the like having a particle diameter of 5 to 30 μm. A fiber-like filler material is distributed inside the developing sleeve so as to protrude from the surface of said developing sleeve, as shown in FIG. 4, the surface of said developing sleeve having concavo-convexities formed thereon by the combination of the protruding portions of the fiber-like material and non-protruding portions of the fiber-like material. The aforesaid concavo-convexities on the surface of the developing sleeve are also sharp, and therefore are unsuitable for use in contact-type monocomponent developing devices. Further, the toner readily fuses to the concavities due to the sharp edges of said concavities. A characteristic of the aforesaid invention is that it assumes that the developing sleeve becomes worn with use and the resulting wear gradually will expose the fiber-like filler material distributed inside the developing sleeve at the surface of said sleeve so as to maintain the concavo-convexities formed on the surface thereof. However, when the surface of the developing sleeve becomes worn, the fiber-like filler material particles protruding from the surface of the developing sleeve break off from the sleeve. When the broken off fiber-like filler material mixes with the toner, said broken off fiber-like filler material not only affects the chargability of the toner and the toner transporting power but also causes damage to the photoconductive member, sleeve and toner thin-layer forming member when said fiber becomes packed between the toner thin-layer forming member and the developing sleeve because the broken off fiber-like filler material has a particle diameter that is greater than the diameter of the toner particles.

Monocomponent developing methods require that the electrical resisticity of the developing sleeve surface be controllable so as to be maintained within a specified range. When the electrical resistivity is less than $10^6$ Ω/cm, image density gradation characteristics deteriorate, and the reproducibility of ultrafine and high-density halftone dots is reduced. Further, when pin hole defects exist in the photoconductive member, or when a discharge is produced from the end of the developing sleeve, an extremely large electric field is generated between the grounded photoconductive member and the developing sleeve and produces a developing bias voltage leak that reduces the developing bias, thereby causing uneven density, grainy fogging, or image dislocation; said voltage leakage may damage the photoconductive member. On the other hand, when the electrical resistivity is greater than $10^{14}$ Ω/cm, density gradation is excellent but image density is inadequate causing deterioration in fine line and halftone dot reproducibility.

Thus, the addition of carbon black, lead oxide or similar powder-like microparticle material has been conventionally suggested as a means of maintaining the adjustment of electrical resistance within the previously described range. However, the aforesaid type of conductive particles generally exhibit a strong cohesive force between electrical conductive particles, making it difficult to achieve uniform dispersion of the particles in the developing sleeve. Moreover, conductivity cannot be imparted unless a large quantity of conductive particles are added because the developing sleeve is made conductive through contact among the particles. However, when a large quantity of conductive microparticles are added, the electrical resistance value is precipitously reduced, making it difficult to control the electrical resistance of the semiconductive region of $10^6$ to $10^{14}$ Ωcm required for the developing sleeve.

When a large quantity of conductive microparticles having inherently poor dispersibility are added as previously described, the dispersion of the electrical resistance within the developing sleeve becomes even greater and causes problems from the standpoint of image quality. Further, conventional conductive microparticles, of which carbon black is a representative example, cause a reduction in electrical resistivity under conditions of high temperature and high humidity because their hydrophilic functional groups are at the surface.

Still further, the strength of the developing sleeve itself is reduced and its wear resistance properties deteriorate when a large quantity of conductive microparticles is added.

SUMMARY OF THE INVENTION

A main object of the present invention is to provide a monocomponent developing device capable of producing sharp precision images.

A further object of the present invention is to provide a monocomponent developing device having excellent density gradation and fine-line reproducibility capable of producing excellent image quality without unevenness.

A still further object of the present invention is to provide a monocomponent developing device with a developing sleeve having on its surface concavo-convexities of a size and smoothness suitable to enhance wear resistance properties.

An even further object of the present invention is to provide a monocomponent developing device having a developing sleeve with easily controlled electrical resistance, to wit, minimal dispersion of electrical resistance.

These and other objects of the invention are accomplished by providing a monocomponent developing device having:

a developing material carrying member having non-insulative whiskers of 0.1 to 1 μm external diameter arranged at least in a surface layer, said carrying member being rotatable opposite a photoconductive member on the surface of which is formed an electrostatic latent image; and a supplying means for supplying toner to the surface of the developing material carrying member.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1A:
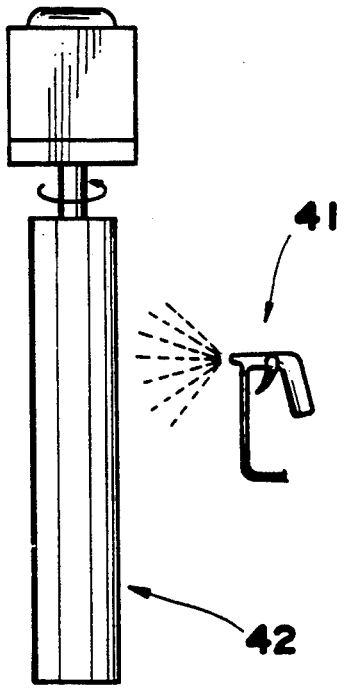
FIG. 1 is a perspective view showing the manufacturing process of developing sleeve used in developing device of the present invention.
Figure 1B:
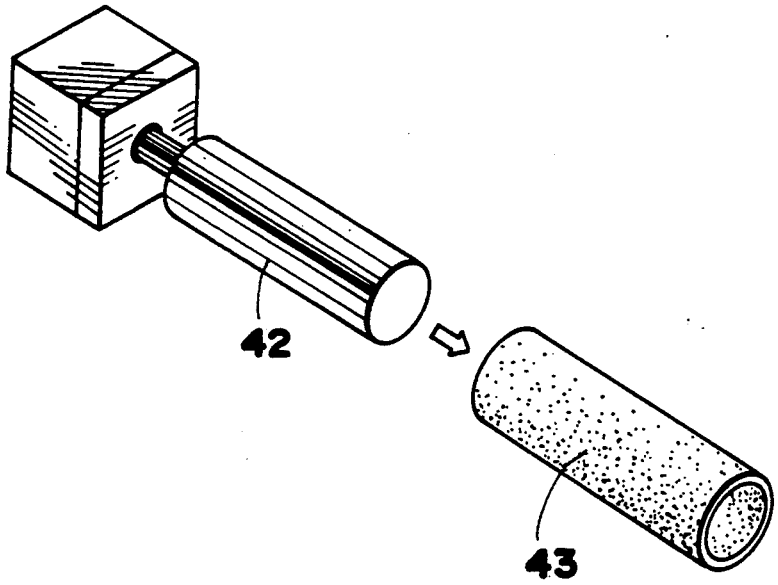
Figure 1C:
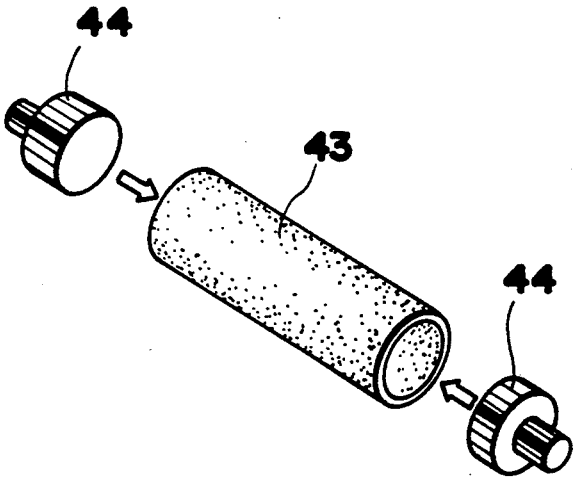
Figure 1D:
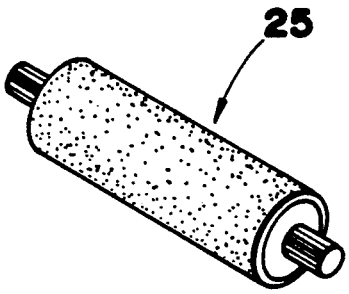

The monocomponent developing device of the present invention is characterized by non-insulative whiskers having a fiber length of 1 to 10 μm and an average external diameter of 0.1 to 1 μm distributed in at least a surface layer of the developing material carrying member.

The mode of the developing material carrying member may be a cylindrical shape metal developing sleeve of aluminum, stainless steel or the like, or an endless belt-type developing sleeve having a moving surface. For example, a belt-type developing material carrying member having an internal circumference longer than an external circumference of one drive roller so as to be loosely mounted over that drive roller and having developing material on the surface thereof for supplying the developing material to a photoconductive member may be used. Further, an endless belt-type developing material carrying member may be used for supplying developing material to a photoconductive member by mounting said endless belt between a pair of rollers.

The previously described developing material carrying members may be made from plastic or ceramic layers having non-insulative whiskers dispersed at least in the surface layer.

Examples of useful plastic materials are phenol resins, epoxy resins, acrylic resins, polycarbonates, polyurethanes, melamine resins, acetyl cellulose, polyvinyl alcohol, urea resin, vinyl chloride and the like. Rubber materials such as, for example, silicone rubber, neoprene, butadiene and the like may also be used.

Examples of useful ceramic layers may incorporate at least one of the following oxide material layers used singly or in combinations of two or more: silicon, titanium, iron, cobalt, alkaline earth metals.

The whiskers distributed throughout the surface layer of the developing material carrying member are non-insulative whiskers having a structure such as, for example, $K_2O.nTiO_2$-X, SiC or the like, and an electrical resistivity of $10^{31\,2}$ to $10^8$ Ωcm, and ideally an electrical resistivity of $10^4$ to $10^4$ Ωcm. Charge build-up characteristics of the developing sleeve are poor when the electrical resistance value of the whiskers is less than $10^{-2}$ Ωcm, and it is difficult to obtain a stable developing material carrying member whose electrical resistance value is greater than $10^6$ Ωcm. In addition, the problem of localized low resistance points may arise in the developing sleeve. On the other hand, it is difficult to obtain a stable developing material carrying member whose electrical resistance value is less than $10^{14}$ Ωcm when the electrical resistivity of the whiskers exceeds $10^8$ Ωcm.

The fiber length of the previously described whiskers shall be 1 to 10 μm, and preferably 2 to 8 μm. When fiber length is shorter than 1 μm, toner transportability improvement and toner carrying member durability improvement cannot be realized. On the other hand, when fiber length is longer than 10 μm, proportionally more of the whisker protrudes from the surface of the sleeve, and durability is reduced while the danger of damage to the photoconductive member is increased.

Further, the diameter of the whisker shall be 0.1 to 1.0 μm, and preferably will be 0.2 to 0.7 μm. Durability is reduced when whisker fiber diameter is less than 0.1 μm, and when the diameter is greater than 0.1 μm the smoothness of the surface brought by the whisker protrude decreases, and the whiskers may be exposed from the surface of the developing material carrying member. Durability is therefore reduced, and not only does durability deteriorate in relation to toner fusion and the like, but the possibility of damage to the surface of the photoconductive member arises.

For example, when a fiber material having fibers with diameters exceeding 0.1 μm is distributed in the surface layer of the developing material carrying member, said fibers protrude from the surface of the developing material carrying member so as to be exposed, thereby reducing the durability of the developing material carrying member. Conversely, the whiskers of the present invention are extremely fine single-crystal fibers forming a needle-like material, which has a high aspect ratio (length/diameter). Accordingly, when the aforesaid whiskers are distributed in the surface layer of the carrying member a developing material carrying member is obtained which possesses, in comparison to carrying members having larger diameter fibers distributed in the surface layer, superior durability, long-term high stability of toner transportability and toner chargability, and can prevent toner fusion.

The amount of whisker distribution in the surface layer of the developing material carrying member shall be 3 to 40 pbw (parts by weight) per 100 parts matrix, and will preferably be 5 to 30 pbw. When the amount of whisker material distribution is less than the aforesaid proportions, there are inadequate concavo-convexities formed on the surface layer making it difficult to regulate uniform electrical properties, so that the desired effective is not obtained from the whisker distribution. On the other hand, when the amount of whisker distribution exceeds a weight fraction of 40 pbw, there is an excessive amount of whiskers in the matrix making it difficult to produce material of sufficient strength, and the whiskers may be exposed on the surface so that smooth concavo-convexities cannot be produced.

The non-insulative whiskers of the present invention can be formed in a three-dimensional network structure comprising fine continuous fibers embedded in resin to control the electrical resistance of the resin. Accordingly, the addition of a small amount of whiskers has excellent effectiveness in controlling electrical resistance, in contra-distinction to glass fibers and like fiber materials. Further, the whiskers of the present invention do not produce a large dispersion in electrical resistance in the developing sleeve because said whiskers are distributed in a uniform dispersion throughout the resin or like material. Therefore, when the whiskers of the present invention are added to a developing sleeve, even slight variations in the electrical resistance on the developing sleeve, as well as variations in the electrical resistance from one developing sleeve to another in a mass production process can be markedly reduced.

In addition, the whiskers of the present invention provide superior control of electrical resistance even when used under high temperature and high humidity conditions because they have no moisture absorption faculty.

Thus, the fine whiskers of the present invention possess excellent characteristics, can be dispersed as an additive of 3–40 parts-by-weight in a plastic or ceramic coating, and the dispersion fluid can be applied to the surface of a developing material carrying member. The whiskers disperse in the dispersion fluid and intertwine in a cotton-like manner. In the aforesaid state, the dispersion fluid is solidified by cooling and drying, which causes a general volumetric contraction of the dispersion fluid. The previously mentioned concavo-convexities are formed during the aforesaid volumetric contraction by slight irregularities in the solidification rate at localized spots in the dispersion fluid of the whiskers themselves in a dispersed configuration in the dispersion fluid, to wit, the previously described whiskers dispersed in the dispersion fluid and intertwined in a cotton-like manner, and the portions of the whiskers dispersed in extreme proximity to the carrying member surface.

Further, the whiskers used by the present invention are very fine, having major diameters of 0.1 to 1.0 μm, such that they are not caused to protrude from the surface of the developing material carrying member due to the surface tension of the dispersion fluid, and are drawn into the inner region of the dispersion fluid. The viscosity of the dispersion fluid generally becomes very high, particularly during solidification, so that it is impossible for the whiskers to protrude from the carrying member surface.

Accordingly, when the whiskers used by the present invention are dispersed in the surface layer of the developing material carrying member, the surface of the carrying member is smooth without sharp protrusions because the whiskers do not protrude from the surface of said carrying member. Moreover, the developing material carrying member has excellent hardness and durability because the majority of whiskers are dispersed along and in proximity to the surface.

The previously described concavo-convexity forming process is not limited only to a developing material carrying member having an application of the whisker dispersion fluid on the surface thereof, but may also be applied to a developing material carrying member formed from resin.

The manufacture of the developing material carrying member used by the device of the present invention may be accomplished by any of several commonly known conventional methods. For example, a resin fluid containing the whisker dispersion may be poured into a tray and hardened, and then the hardened resin may be formed into a cylindrical shape as a developing sleeve, or the resin fluid may be poured into a cylindrical metal mold. Other possible methods include, for example, spray coating using a spray or spreading application of a fluid containing the whisker dispersion over a cylindrical metal mold.

The surface roughness of the thus produced developing sleeve shall be 2 to 20 μm. When the surface roughness is within the aforesaid range, superior toner transporting characteristics are obtained, and the toner charging capacity rises more rapidly.

EXAMPLE 1

A first example of the present invention is described hereinafter with reference to FIGS. 1*a* through 1*d* and FIG. 2.

Figure 2:
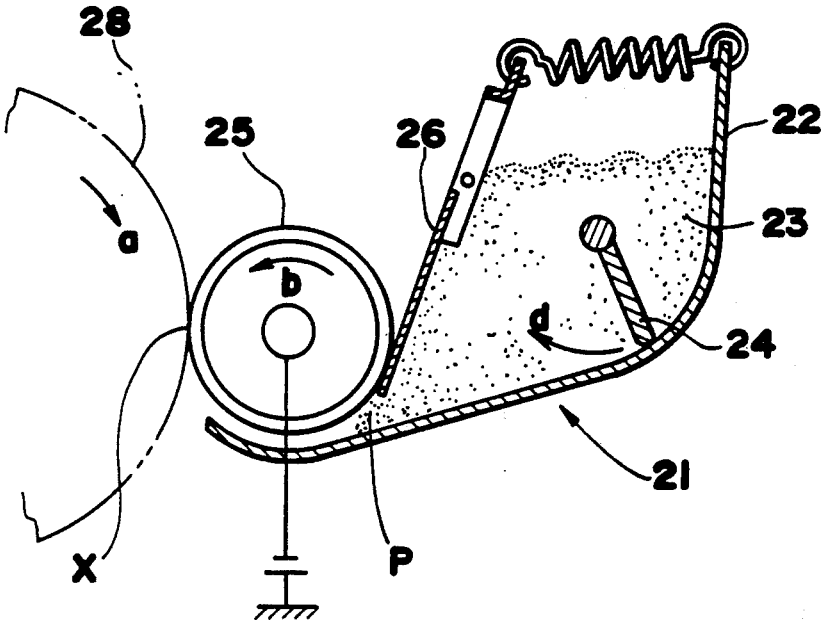
FIG. 2 is a brief section view of a first embodiment of the developing device of the present invention.

FIG. 2 is a section view showing the developing device of the first example. Developing device 21 is disposed adjacent to photoconductive drum 28 which is rotatable in the arrow [a] direction.

Developing device 21 comprises a developing sleeve 25 rotatably disposed opposite photoconductive drum 28, a pressure blade 26 making pressure contact with the exterior surface of the aforesaid developing sleeve 25, a casing 22 that accommodates toner 23 as well as supports and houses members 25 and 26. Casing 22 is provided in its interior a mixing member 24 that is rotatable in the arrow [d] direction, said mixing member 24 continuously mixing toner 23 that has accumulated in casing 22 so as to move said toner 23 in the arrow [d] direction.

The operation of developing device 21 during the developing process is hereinafter described.

In FIG. 2, the developing material 23 accommodated in hopper 22 of developing device 21 is fed, by means of the rotation of mixing member 24, to regulating portion [P] formed by the surface of developing material carrying member (developing sleeve) 25 and the developing material thickness regulating member 26 which make pressure contact therewith. An electrically charged thin-layer of developing material is formed on the surface of the developing sleeve 25 at the regulating portion [P], and said thin-layer is transported, by means of the rotation of developing sleeve 25, to developing region [X] which comes into contact with photoconductive drum 28. At developing region [X], the thin-layer developing material maintained on the surface of developing sleeve 25 comes into contact with the surface of photoconductive drum 28, and is transferred to the surface of the photoconductive drum 28 in correspondence with an electrostatic latent image formed thereon, thereby developing said latent image.

The developing sleeve 25 of developing device 21 was produced by the method described below.

| Resin Solution Composition | Parts by Weight (%) |
|---|---|
| Epoxy resin (Epocoat 1007 Shell Chemical Co., K.K.) | 28 |
| Phenol resin (Scadoform L9 (70% solution) Scado-Archer-Daniels N.V.) | 17 |
| Diacetone alcohol (DAA) | 27.5 |

-continued

| Resin Solution Composition | Parts by Weight (%) |
|---|---|
| Xylol | 27.5 |

A resin liquid solution was prepared with 8 pbw non-insulative whiskers (Otsuka Chemical Co., K.K.; BK-100: Calcium titanate whiskers subjected to conductive processing (5 μm mean fiber length, 0.3 μm diameter, $10^4$ Ωcm electrical resistance)) in 100 pbw resin solution (nonvolatile portion 40%), and suitably mixed and dispersed using a ball mill. Then, the liquid solution was applied to a cylindrical metal mold 42 which was rotated continuously using spray gun 41, as shown in FIG. 1, so as to produce a thin film layer having a thickness of 2.0 mm when dried, said film layer then being heated and hardened for 1 hr at 150° C. The obtained resin cylinder 43 was removed from the metal mold 42 (FIG. 1*b*), and cut to a specified length, then aluminum shafts 44 were mounted at both ends (FIG. 1*c*) to produce the developing sleeve 45 shown in FIG. 1*d*.

The electrical resistance values were measured at nine points on developing sleeve 45, and the mean resistance value was found to be $10^{11}$ Ωcm. The difference in the logarithmic values of the maximum and minimum resistance values (hereinafter referred to as "dispersion value"), which would become the known standard dispersion of electrical resistance values on the sleeve surface, was 0.2, confirming that the dispersion of the resistance values on the sleeve surface was extremely small. The surface roughness of the sleeve was also measured and found to be 7 μm, equivalent to a pencil lead hardness rating of HB.

Next, the aforesaid developing sleeve was placed in a developing device, shown in FIG. 2, which was then installed in an electrophotographic copying machine, and density reproducibility was checked for 0.5 mm wide line images, 3×4 cm solid images, and 150 line screen halftone dot images using a nonmagnetic monocomponent developing material. Solid and halftone dot density was measured using a reflection densitometer, solid image and halftone dot images was measured using DM-272 (Dainippon Screen Manufacturing Co., Ltd.) and line density was measured using a Sakura densitometer PDM-5 type BR (Konishiroku Photo Industry Co., Ltd.).

Image density (ID) measurements were made by copying DataQuest Corporation reference charts under suitable exposure conditions, and measuring the image densities of the solid regions using suitable filters on a Sakura densitometer.

DEVELOPING CONDITIONS

| | |
|---|---|
| Initial surface potential of photoconductive member | −400 to −800 volts |
| Developing bias | −100 to −300 volts |
| Toner charge | +15 to +20 μC/g |

Photoconductive member: Organic photoconductive member (negative charge laminated-layer type photoconductive member)

Developing material: Nonmagnetic monocomponent high-resistance toner (positive charge)

The obtained image possessed excellent solid image gradation reproducibility, low density line reproducibility, and halftone dot images were also reproduced with accuracy. Durability testing comprised making 100,000 copies, and excellent image quality similar to that of the initial copies was obtained at the end of the test with no changes were observed in wear or toner fusion to the sleeve. When image density was measured at the solid portions of the images, image density of 1.4 was measured for initial images and after the 100,000 copy durability test the image density of 1.4 remained unchanged. Sleeve surface roughness after the durability test was 6 μm.

EXAMPLE 2

A second example of the present invention is described hereinafter with reference to FIG. 3.

Figure 3:
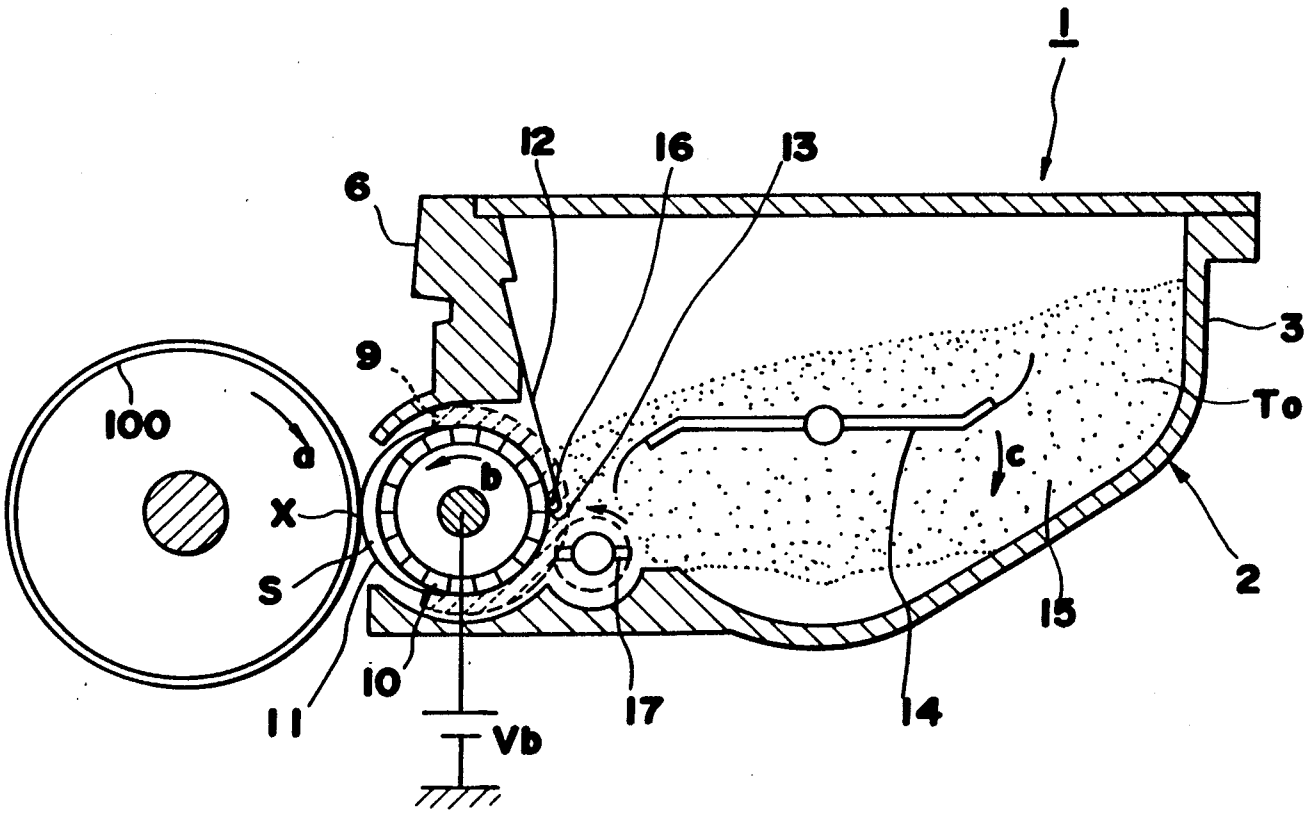
FIG. 3 is a brief section view of a second embodiment of the developing device of the present invention.
Figure 4:
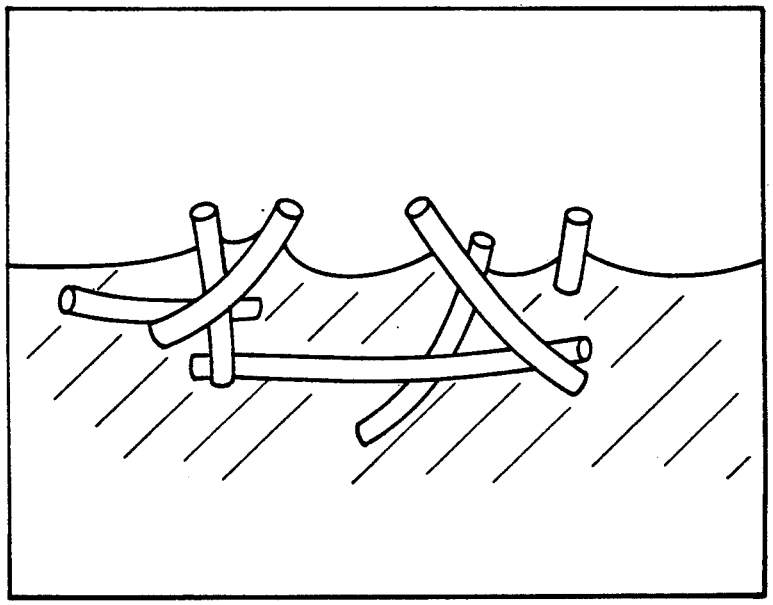

FIG. 3 is a section view showing a second example of a developing device 1 of the present invention. Developing device 1 is disposed adjacent to a photoconductive drum 100 which is rotatable in the arrow [a] direction.

Developing device 1 comprises a developing roller 10 forming a rotating member, a tubular belt-like sleeve 11 mounted over said developing roller 10, guide members 9 which press said belt-like sleeve 11 toward said developing roller 11, a contact blade 12 which makes pressure contact with the exterior surface of said belt-like sleeve 11, and a casing 3 which accommodates the toner $T_o$ and supports and houses the aforesaid members.

The developing roller 10 that drives the belt-like sleeve comprises a conductive member made of aluminum or the like provided with a roughened surface or a surface layer of conductive elastic rubber. A developing bias voltage is applied to the developing roller 10.

The aforesaid belt-like sleeve 11 has on its surface a spray coat layer of a resin liquid solution, and is slightly longer in circumference than the exterior circumference of developing roller 10 so as to be mounted over developing roller 10.

Guide members 9 are disposed at both ends of developing roller 10 with the belt-like sleeve mounted thereon. The guide members press the aforesaid belt-like sleeve onto the developing roller 10 to converge the slack in said belt-like sleeve 11 at an aperture angle Θ of the guide members provided at the surface opposite the photoconductive drum, thereby forming a uniform space [S]. The aforesaid slack makes contact with the surface of photoconductive drum 100.

When the friction coefficient between the exterior surface of developing roller 10 and the interior surface of belt-like sleeve 11 is designated $\mu_1$, and the friction coefficient between the exterior surface of belt-like sleeve 11 and the interior surface of guide member 9 is designated $\mu_2$, the relationship $\mu_1 > \mu_2$ obtains. Therefore, when developing sleeve 10 rotates in the arrow [b] direction, the belt-like sleeve 11 moves in concert in the same direction.

The pressure blade 12 is provided with a metallic round bar 16 at its leading edge, and is attached to the backside of support member 6 provided at the upper portion of developing roller 10. Blade 12 presses belt-like sleeve 11 against the backside of developing roller 10.

A toner hopper 15 is provided in casing 3. A mixing member 14, which is rotatable in the arrow [c] direction, is provided inside toner hopper 15 to continuously mix the toner $T_o$ accommodated therein and move said toner in the arrow [c] direction.

The operation of the developing device of the present invention during the developing process is hereinafter described with reference to FIG. 3.

Developing roller 10 and mixing member 14 are rotated in the arrow [b] and arrow [c] direction, respectively, by means of a drive source not shown in the drawing, so as to forcefully move toner $T_o$ in the arrow [c] direction. On the other hand, belt-like sleeve 11 rotates and travels in concert with developing roller 10 in the arrow [b] direction by means of the frictional force produced between said sleeve and developing roller 10. The toner $T_o$ accommodated in toner hopper 15 adheres to the surface of belt-like sleeve 11 due to the direct contact with and electrostatic force produced through said direct contact with said belt-like sleeve 11, so as to be transported in the arrow [b] direction. Toner $T_o$ is fed through the portion 13 formed by the belt-like sleeve 11 and the leading edge of blade 12, arrives at the pressure-contact portion of said blade 12 and is uniformly applied in a thin layer to the surface of belt-like sleeve 11 and triboelectrically charged with a specified positive or negative polarity. The thin layer of toner $T_o$ is maintained on belt-like sleeve 11 by means of the electrostatic force produced by its own charge, and the toner $T_o$ is carried to the developing region [X] disposed opposite photoconductive drum 100. At developing region [X], the toner $T_o$ is transferred to an electrostatic latent image formed on the surface of photoconductive drum 100 by means of an electric field generated by the difference in voltage between the surface potential of photoconductive drum 100 and the bias voltage applied to developing roller 10, thereby forming a toner image on the surface of photoconductive drum 100.

Belt-like sleeve 11 is in contact with photoconductive drum 100, and a space [S] is formed between said belt-like sleeve 11 and developing roller 10. Belt-like sleeve 11 makes soft contact with the surface of photoconductive drum 100 with a suitable nip width and without irregularities due only to the rigidity of the belt-like sleeve itself because at that point the belt-like sleeve is in the non-contact state with the surface of the developing roller 10. Thus, a uniform toner image is formed corresponding to the electrostatic latent image on photoconductive drum 100. Further, it is possible to have a speed differential between the circumferential speed of photoconductive drum 100 and the speed of belt-like sleeve 11, so that a toner image once formed on the surface of photoconductive drum 100 cannot be disturbed through a rubbing or physical force produced by belt-like sleeve 11.

Toner $T_o$ which remains on belt-like sleeve 11 in the developing region [X] continues to be transported in the arrow [b] direction along with said belt-like sleeve 11. Toner $T_o$ is again supplied to belt-like sleeve 11 by the rotation of mixing member 14, and again a uniform charged toner thin layer is formed by the pressure-contact portion of blade 12 and the previously described process is repeated.

The belt-like sleeve 11 installed in developing device 1 may be produced by the methods described below.

A spray coating of a resin fluid solution identical to that used in Example 1 was applied to the surface of an endless thin-film member of 40 μm thickness produced by an electroforming method, to obtain a resin coat layer 5 μm in thickness.

The mean electrical resistance value of the belt-like sleeve was $10^{11}$ Ωcm, and the resistance dispersion value was 0.3. The belt-like sleeve had a degree of rigidity given a value of 1.3, as expressed in terms of Young's modulus of elasticity, thus fulfilling the requirement of a modulus of elasticity of 0.05 to 10 to make contact with the photoconductive drum at a suitable pressure. The surface roughness of the belt-like sleeve was 2.6 μm, comparable to a pencil lead hardness rating of HB.

The belt-like sleeve produced in the aforesaid manner was installed in developing device 1 (refer to FIG. 3), and tested in an identical manner to that described in Example 1.

The obtained images had excellent line reproducibility, solid image gradation characteristics and halftone dot reproducibility, as well as an initial solid image image density (ID) of 1.4, identical to the results in Example 1. In the 100,000 copy durability test, there was no evidence of toner fusion or separation of the coating layer; final surface roughness was 2.4 μm, and final solid image ID was 1.4 with stable images being produced throughout the test.

EXAMPLE 3

In place of the belt-like sleeve used in Example 2, a belt-like sleeve produced by the method described hereinafter was installed in developing device 1 and used as Example 3.

The belt-like sleeve used in Example 3 was obtained by spray coating a silicone oxide ceramic coating (ceramet) containing a dispersion of non-insulative whiskers identical to that described in Example 1 onto the surface of an endless thin-layer member 40 μm in thickness produced by an electroforming method, and the obtained member was heated at 120° C. for 2 hr. The thus produced belt-like sleeve had a ceramic hard coating layer 1.7 μm in thickness.

This belt-like sleeve had a mean electrical resistance value of $10^{11}$ Ωcm, and a resistance dispersion value of 0.2. Young's modulus of elasticity for the aforesaid belt-like sleeve was 1.4; the surface roughness was 1.0 μm, equivalent to a pencil lead hardness rating of 2H.

When the aforesaid sleeve was subjected to the same durability testing as the sleeve in Example 2, it was, found to have excellent line reproducibility, solid image gradation characteristics and halftone dot reproducibility, as well as an initial solid image ID of 1.5. In the 100,000 copy durability test, there was no evidence of toner fusion or coating layer separation; final surface roughness was 0.9 μm, and final solid image throughout the test.

EXAMPLE 4

A developing sleeve was manufactured in substantially the same way as described in Example 1, with the exception of the whisker content of 25 pbw. The obtained developing sleeve had a mean electrical resistance value of $10^{10}$ Ωcm and a resistance dispersion value of 0.2. Surface roughness of the developing sleeve was 10 μm and surface hardness was equivalent to a pencil lead hardness rating of H.

The aforesaid developing sleeve was installed in developing device 21 of Example 1, and durability tests also were conducted as described in Example 1. Adequate image density of 1.5 was obtained both initially and after 100,000 copies and excellent image quality was maintained. When the sleeve was examined following the durability test, there was no evidence of either toner fusion to the surface or whisker exposure, and measured surface roughness was 9 μm.

EXAMPLE 5

Eight parts-by weight of carbon whiskers (Asahi Chemical Industry Co., Ltd.; 10 μm mean fiber length, 0.2 μm mean diameter, electrical resistance $7\times10^{-4}$ Ωcm) were added to 100 pbw of nylon-12 resin (Rilsan AESNO, Toray Co., Ltd.), and the mixture was suitably kneaded in a heat fusion state using a roll kneading machine. Thereafter, the substance was cooled, and ground into a pellet shape using a grinder. The pellet shaped resin was formed into a belt-like sleeve having a 200 μm thickness using an injection molding machine. The mean electrical resistance value of the obtained resin sleeve was $5\times10^{6}$ Ωcm, and the resistance dispersion value was 0.2. Surface roughness of the sleeve was 1 μm, equivalent to a hardness rating of HB. Also, the belt-like sleeve had a modulus of elasticity of 3.1.

The obtained belt-like sleeve was installed on the exterior of developing roller 10 in developing device 1 in place of the belt-like sleeve of Example 2, and the same tests were conducted as described in Example 2. Line reproducibility, solid image gradation characteristics, and halftone dot reproducibility of the obtained images were all excellent. Suitable image density of 1.4 was obtained both initially and after 100,000 copies, and excellent image quality was maintained. When the belt-like sleeve wa examined following completion of the durability test, no evidence was found of toner fusion to the surface, whisker exposure, or cracking. Surface roughness was 1 μm.

REFERENCE EXAMPLE 1

A developing sleeve having an electrical resistance $10^{15}$ Ωcm and a surface roughness of 0.2 μm was manufactured in an identical manner to that described in Example 1 except that whiskers were not used. When the obtained sleeve was subjected to the same testing described in Example 1, the final image density was less adequate than the initial image density and the solid region had an ID of 0.6 due to the high electrical resistance; partial print fogging was prevalent.

Further, the sleeve had a resistance dispersion value of 0.1, and although dispersion was slight, the sleeve had a rated hardness of B which was lower than that of the sample with whisker additive.

REFERENCE EXAMPLE 2

A developing sleeve having a surface electrical resistance of $10^{14}$ Ωcm was manufactured in an identical manner to that described in Example 1 except that 50 pbw of fine conductive particles (White conductive powder: W1 (brand name) Mitsubishi Metal Corporation, particle diameter: 0.2 μm, electrical resistance: about 10 Ωcm)) were added instead of the 8 pbw of whiskers. The sleeve was subjected to a blast process to give it a surface roughness of 8 μm.

When the aforesaid sleeve was subjected to the same tests described in Example 1, the image density was slightly lower initially at 1.1 due to the high electrical resistance. After 30,000 printings were made there was rapid deterioration in image density and unevenness in the image (ID=0.5). When the surface of the sleeve was examined at that time, the surface concavo-convexities formed by the blasting process showed signs of wear and toner had fused thereon. Sleeve surface roughness was 2 μm at that time.

The electrical resistance dispersion value of the sleeve was 1.6, indicating a large dispersion in electrical resistance on the sleeve surface. The sleeve had a measured hardness rating of B, which was less than the hardness of the sample similarly measured in Example 1.

REFERENCE EXAMPLE 3

A sleeve was manufactured in the same manner as described in Reference Example 1 and the surface was subjected to a blast process to produce a sleeve having a surface roughness of 10 μm. The sleeve was then tested in the same manner as described in Reference Example 1. The initial image density was low at 1.1, and line reproducibility and halftone dot reproducibility were also inferior. Image density was reduced even future to 0.7 after only 20,000 copies in the durability test. When the sleeve was examined after 100,000 copies, the surface concavo-convexities were almost entirely worn away, and the toner fusion to the remaining portion of the concavo-convexities was evident. Surface roughness of the sleeve was 1 μm at that time.

Although the electrical resistance dispersion value was low at 0.1, the sleeve also had a low hardness rating of B.

REFERENCE EXAMPLE 4

A resin coating layer was applied to a belt-like sleeve in substantially the same manner as described in Example 2, with the exception that said resin coating layer did not contain whiskers. The belt-like sleeve was subjected to a blast process to produce a sleeve having a surface roughness of 2.4 μm and an electrical resistance of $10^{15}$ Ωcm. When the aforesaid belt-like sleeve was tested in the same manner described in Example 2, it was found that image density had been reduced to 0.8 after 50,000 copies due to the high electrical resistance, and after 80,000 copies the resin coating had started to separate from the sleeve. When the belt-like sleeve was examined at that time it showed severe wear of the concavo-convexities and toner fusion. Surface roughness of the sleeve was 0.5 μm at that time.

Although the belt-like sleeve had a Young's modulus of elasticity of 1.3 and a low electrical resistance dispersion value of 0.1, it also had a low hardness rating of B.

REFERENCE EXAMPLE 5

A sleeve having a surface electrical resistance of $10^{15}$ Ωcm and a surface roughness of 8 μm was manufactured in substantially the same way as described in Example 1, with the exception that the 8 pbw of whiskers were replaced by 50 pbw of fiber-like filler material comprising glass fiber 7 μm in diameter which were ground and had a mean fiber length of 40 μm.

When the aforesaid sleeve was subjected to the same testing procedures as described in Example 1, it had a low initial image density of 0.8 due to the electrical resistance. After 50 copies, damage to the photoconductive member caused by rubbing of the glass fiber ends was evident in the copy image, and stripes were evident in the copy image after 100 copies. Further, released fiber-like filler material accumulated within the developing device, and accumulated between the toner carrying member and the regulating member, and image defects appeared. A surface roughness of 13 μm was measured at that time. When the surface of the sleeve was examined, it was found that the fiber-like filler material was exposed and protruding from the surface of the resin dispersion medium in many places, and extremely sharp concavo-convexities had been produced with toner fusion on parts.

Further, the sleeve had a high electrical resistance dispersion value of 1.8, indicating a large dispersion in resistance on the surface of the sleeve. The sleeve had a low hardness rating of B.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they are to be construed as being included therein.

What is claimed is:

1. A monocomponent developing device comprising:

a developer transporting member confronting a photoreceptor and rotatably mounted for developing an electrostatic latent image formed on a surface of said photoreceptor, said developer transporting member containing means for controlling medium resistivity of the surface of the developer transporting member at not more than $10^{14}$ Ωcm, said means comprising a whisker having an 0.1 μm to 1 μm outside diameter in a surface layer thereof, and supplying means for supplying a toner to the surface of the developing transporting member.

2. A monocomponent developing device as claimed in claim 1 wherein said toner supplied by said supplying means forms a toner layer on the surface of the developer transporting member, said toner layer being in contact with the surface of the photoreceptor.

3. A monocomponent developing device as claimed in claim 1 where a length of the whisker is $1_{\mu m}$ to $10_{82}$ m.

4. A monocomponent developing device as claimed in claim 1 wherein the developer transporting member is formed of resin materials.

5. A monocomponent developing device as claimed in claim 1 wherein the toner supplied by the supplying mean sis non-magnetic.

6. A monocomponent developing device as claimed in claim 1 wherein said whisker maintains the resistivity of any portion of the surface of the developer transporting member without unevenness within the range of $10^6$ Ωcm to $10^{14}$ Ωcm.

7. A monocomponent developing device comprising:

a developing roller rotatably mounted and confronting a photoreceptor on which an electrostatic latent image is formed;

a flexible member cylindrically formed and loosely mounted at the outside of said developing roller, said flexible member having a surface layer which includes means for controlling a resistivity of the surface layer of the flexible member, said means including a whisker having a resistivity of $10^{-2}$ Ωcm to $10^8$ Ωcm;

forming means for forming a toner layer on the surface of the flexible member; and biasing means for biasing the flexible member to a side opposite to a side confronting the photoreceptor of the developing roller so that a slack of the flexible member is formed at the side confronting the photoreceptor of the developing roller to contact with the surface of the photoreceptor.

8. A monocomponent developing device as claimed in claim 7 wherein the flexible members is formed of resin materials.

9. A monocomponent developing device comprising:

a developer transporting member rotatably mounted and contacting with a surface of a photoreceptor for developing an electrostatic latent image formed on the surface of said photoreceptor, said developer transporting member containing means for controlling a resistivity of the surface of the developer transporting member, said means comprising a whisker at least in a surface layer thereof and said whisker having a resistivity of $10^{-2}$ Ωcm to $10^8$ Ωcm; and forming means for forming a toner layer on the surface of the developing transporting member.

10. A monocomponent developing device comprising:

a developing roller rotatably mounted and confronting a photoreceptor on which an electrostatic latent image is formed;

a flexible member cylindrically formed and loosely mounted at an outside of said developing roller, said flexible member having a surface layer which contains means for controlling a resistivity of the surface layer of the flexible member, said means comprising a whisker having a diameter of 0.1 μm to 1 μm and a resistivity of $10^{-2}$ Ωcm to $10^8$ Ωcm;

forming means for forming a toner layer on the surface of the flexible member; and biasing means for biasing the flexible member to a side opposite to a side confronting the photoreceptor of the developing roller so that a slack of the flexible member is formed at the side confronting the photoreceptor of the developing roller to contact with the surface of the photoreceptor.

11. A monocomponent developing device comprising:

a developer transporting member rotatably mounted and contacting with a surface of a photoreceptor for developing an electrostatic latent image formed on the surface of said photoreceptor, said developer transporting member containing means for controlling a resistivity of $10^{-2}$ Ωcm to $10^8$ Ωcm, said means comprising a whisker at least in a surface layer thereof wherein the whisker has an outside diameter of 0.1 μm to 1 μm and has a resistivity of $10^{-2}$ Ωcm to $10^8$ Ωcm; and forming means for forming a toner layer on the surface of the developer transporting member.

12. A monocomponent device comprising:

a developer transporting member confronting a photoreceptor and rotatably mounted for developing an electrostatic latent image formed on a surface of said photoreceptor, said developer transporting members containing means for controlling the medium resistivity of the surface of the developer transporting member at not more than $10^{14}$ Ωcm, said means including only fine whiskers as a resistance adjusting agent at least in a surface layer thereof; and supplying means for supplying a toner to the surface of the developing transporting member.

13. A monocomponent device as claimed in claim 12 wherein said whiskers have a volume resistivity of $10^{-2}$ Ωcm to $10^8$ Ωcm.

* * * * *